US008613562B2

(12) United States Patent
Shirotori et al.

(10) Patent No.: US 8,613,562 B2
(45) Date of Patent: Dec. 24, 2013

(54) CUTTER WITH EXIT HAVING FIRST AND SECOND SURFACES OFFSET FROM TRANSPORTATION PATH

(75) Inventors: Motoyoshi Shirotori, Shiojiri (JP); Shinsuke Tomomatsu, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 548 days.

(21) Appl. No.: 12/715,348

(22) Filed: Mar. 1, 2010

(65) Prior Publication Data

US 2010/0221055 A1 Sep. 2, 2010

(30) Foreign Application Priority Data

Mar. 2, 2009 (JP) ..... 2009-047661

(51) Int. Cl.
*B41J 11/70* (2006.01)

(52) U.S. Cl.
USPC ..... 400/621; 400/646; 83/166

(58) Field of Classification Search
USPC ..... 400/621, 646; 347/157; 83/166
See application file for complete search history.

(56) References Cited

U.S. PATENT DOCUMENTS

| | | | | | |
|---|---|---|---|---|---|
| 4,975,781 | A * | 12/1990 | Hirose | ..... | 358/304 |
| 5,115,322 | A * | 5/1992 | Jang | ..... | 358/304 |
| 5,560,293 | A * | 10/1996 | Boreali et al. | ..... | 101/288 |
| 6,640,444 | B1 | 11/2003 | Harada et al. | | |
| 7,290,765 | B2 * | 11/2007 | Carter et al. | ..... | 271/314 |
| 7,878,724 | B2 * | 2/2011 | Yamagata | ..... | 400/664 |
| 2004/0251618 | A1 | 12/2004 | Niizeki | | |
| 2008/0304895 | A1 | 12/2008 | Masuda et al. | | |
| 2010/0192746 | A1 * | 8/2010 | Flood et al. | ..... | 83/697 |

FOREIGN PATENT DOCUMENTS

| | | | | | |
|---|---|---|---|---|---|
| EP | 1 749 623 | A1 | | 2/2007 | |
| JP | 56-010455 | U1 | | 7/1979 | |
| JP | 61177858 | A | * | 8/1986 | ..... H04N 1/00 |
| JP | 61206676 | A | * | 9/1986 | ..... B41J 11/70 |
| JP | 04163172 | A | * | 6/1992 | ..... B41J 11/70 |
| JP | 06166230 | A | * | 6/1994 | ..... B41J 15/04 |
| JP | 09-019890 | A | | 1/1997 | |
| JP | 2000015880 | A | * | 1/2000 | ..... B41J 11/66 |
| JP | 2000-175535 | A | | 6/2000 | |
| JP | 2002002041 | A | * | 1/2002 | ..... B41J 11/70 |
| JP | 2003-159845 | A | | 6/2003 | |
| JP | 2003326492 | A | * | 11/2003 | ..... B26D 1/08 |
| JP | 2006-256183 | A | | 9/2006 | |
| JP | 2007111881 | A | * | 5/2007 | |
| JP | 2008-168564 | A | | 7/2008 | |

* cited by examiner

*Primary Examiner* — Daniel J Colilla
(74) *Attorney, Agent, or Firm* — Kilpatrick Townsend & Stockton LLP

(57) ABSTRACT

A printer with a cutter is provided that can discharge cut-offs in a stable condition. A printer includes a transportation path, a transportation mechanism that conveys a recording medium along the transportation path, a fixed knife having a cutting edge, a movable knife having a cutting edge and moving between a standby position and a cutting-completed position, and an exit disposed along the transportation path. The exit includes a narrow opening defined by a first elongated side offset from the transportation path beyond the movable-knife cutting edge in the cutting-completed position, and a second elongated side opposite the first elongated side and offset from the transportation path opposite to the first elongated side. The second elongated side can be located immediately adjacent to the transportation path, for example, by less than or equal to 2 mm.

14 Claims, 7 Drawing Sheets

CUTTER WITH EXIT HAVING FIRST AND SECOND SURFACES OFFSET FROM TRANSPORTATION PATH

CROSS-REFERENCES TO RELATED APPLICATIONS

This application claims priority under 35 U.S.C. §119 to Japanese Patent Application No. 2009-047661 filed on Mar. 2, 2009, the entire disclosure of which is expressly incorporated by reference herein.

BACKGROUND

1. Technical Field

The present invention relates to an automatic cutter (a cutter) that cuts recording paper or other continuous paper web disposed between a movable knife and a fixed knife by causing the movable knife to move toward the fixed knife and to slide along the fixed knife to cut the medium therebetween, and relates to a printer having the automatic cutter. More particularly, the invention relates to an automatic cutter and to a printer having the automatic cutter that can discharge the cut-off portion (the paper that was cut off) in a stable condition from the paper exit.

2. Related Art

Printers that print on recording paper such as roll paper or label paper may have an automatic cutter for cutting off the printed portion of the recording paper after printing is completed. The automatic cutter is typically located downstream from a printing position (the print head position) and prior to a paper exit along a transportation path for the recording paper between the printing position and the exit. Once separated by the automatic cutter, the cut-off portion of the recording paper is discharged from the paper exit. An automatic cutter may include a scissor cutter that cause a movable knife to pivot in a scissor action to and away from a fixed knife, or a guillotine cutter in which the movable knife moves bidirectionally in a straight line to and away from the fixed knife.

Japanese Unexamined Patent Appl. Pub. JP-A-H09-19890 discloses a scissor type automatic paper cutter that is used in printers and other devices. In the automatic cutter disclosed in JP-A-H09-19890, the fixed knife is disposed with the cutting edge facing up. And the movable knife pivots at one end in the cutting direction of the movable knife between a standby position where a gap is formed between the cutting edge of the movable knife and the cutting edge of the fixed knife, and an cutting-completed position where the cutting edge of the movable knife and the cutting edge of the fixed knife overlap throughout the entire range of the cutting direction. The recording paper is transported along a transportation path so as to be inserted to the paper cutter from the fixed knife side and is discharged from the movable knife side.

The paper exit from which the cut-off portion is discharged typically has a narrow opening so that foreign matter is not inadvertently inserted from the outside, and is generally long and narrow in the cutting direction. As shown in FIG. 7, by positioning the bottom edge 100*a* of the paper exit 100 slightly below the cutting edge 101*a* of the fixed knife 101, and positioning the top edge 100*b* of the paper exit 100 slightly above the cutting edge 101*a* of the fixed knife 101, the vertical size of the opening is reduced. This prevents the paper conveyed to the automatic cutter from hitting the top edge 100*b* and causing a paper jam. More specifically, the positions of the bottom edge 100*a* and top edge 100*b* of the paper exit 100 and the position of the cutting edge 101*a* of the fixed knife 101 are determined so that the paper conveyed toward the automatic cutter is directed to a position substantially in the middle of the gap between the bottom edge 100*a* and top edge 100*b*.

When the movable knife 102 moves toward the cutting-completed position with this paper exit 100, a stroke of a certain length is needed for the movable knife 102 to cut the paper. And the movable knife 102 overlaps the fixed knife 101 and the cutting edge 102*a* of the movable knife 102 moves to a position below the cutting edge 101*a* of the fixed knife 101. As a result, the upstream end part 103*a* of the cut-off 103 is thus pushed by the movable knife 102 below the bottom edge 100*a* of the paper exit 100. This may result in a paper jam. As a result of the upstream end part 103*a* of the cut-off 103 being pushed down, the downstream end part 103*b* of the cut-off 103 tends to be directed upward pivoting at the bottom edge 100*a* with the vertical movement limited by the narrow vertical size of the paper exit 100. And the upstream side of the cut-off 103 curls in the narrow gap between the fixed knife 101 and the paper exit 100. When the movable knife 102 returns to the standby position, the energy stored in the curled portion is released and causes the cut-off 103 to spring back and possibly pop out of the paper exit 100. If the cut-off 103 pops out of the paper exit 100 and falls onto the floor, for example, there is a significant loss of user convenience.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

A cutter (an automatic cutter) and a printer having a cutter (an automatic cutter) are provided. Such a cutter may enable the discharging of a cut-off portion of a recording medium (e.g., roll paper, label paper) in a stable condition from a narrow paper exit of a printer. Such a cutter can also be used to cut suitable sheet materials (e.g., sheet metal, sheet plastic, etc.).

Thus, in a first aspect, a cutter is provided for cutting off a portion of a sheet material transported along a transportation path. The cutter includes a fixed knife having a cutting edge, a movable knife having a cutting edge and moving between a standby position and a cutting-completed position to cut off the portion in cooperation with the fixed knife, and an exit disposed along the transportation path and adjacent the knives to discharge the cut-off portion. The exit includes a narrow substantially-rectangular opening defined at least in part by a first elongated side offset from the transportation path beyond the movable-knife cutting edge in the cutting-completed position, and a second elongated side opposite the first elongated side and offset from the transportation path opposite to the first elongated side.

With the cutter according to the first aspect of the invention, the paper exit is defined at least in part by mutually opposing surfaces on the fixed knife side and the movable knife side. And the distance between these opposing surfaces can be limited to a distance from a position just beyond the movable-knife cutting edge in the cutting-completed position to substantially the same position as the fixed-knife cutting edge. Insertion of foreign objects from outside the paper exit may therefore be inhibited.

In addition, a problem with the related art is that when cutting paper the cutting edge of the movable knife moves beyond the edge of the paper exit thereby causing the upstream end part of the cut-off portion to curl. As a result, the curled part of the cut-off portion may spring back when the movable knife returns to the standby position. And the cut-off portion may thus pop out from the paper exit.

In this first aspect of the invention, however, the surface of the paper exit on the fixed knife side is formed outside the range of movable knife movement (the stroke) when the movable knife cuts. The occurrence of paper jams may therefore be reduced or prevented because the upstream end part of the cut-off portion is not pushed beyond the exit surface on the fixed knife side when the movable knife moves to the cutting-completed position. The cut-off portion is also not made to curl. As a result, the operator can easily pick up the cut-off portion and user convenience is good because the cut-off portion will not spring up and pop out of the paper exit when the movable knife returns to the standby position.

In many embodiments, the fixed-knife cutting edge is disposed close to the transportation path. For example, the fixed-knife cutting edge can be disposed substantially on the transportation path.

In many embodiments, the sheet material cut by the cutter includes a recording medium. For example, the sheet material can include a recording medium that includes paper.

In many embodiments, a roller is disposed to the second elongated side of the exit.

In such embodiments, the sheet material conveyed toward the cutter will therefore not hit a surface on the second elongated side of the exit and cause a paper jam. With this configuration the sheet material is guided smoothly as the roller rotates.

In many embodiments, protrusions are formed on the outside surface of the roller.

The sheet material is thus guided in contact with the end points of the protrusions formed on the outside surface of the roller. Smudging or smearing of a printed portion of the sheet material due to rubbing can thus be avoided when the surface of the sheet material has been printed on. In addition, when handling label paper, for example, there is no rubbing of the label paper against the first elongated side of the exit, and transfer and adhesion of adhesive from the label paper to the roller or protrusions may be reduced or prevented.

In many embodiments, the movable knife pivots on a support shaft between the standby position and the cutting-completed position.

In many embodiments, the second elongated side of the exit includes a sloped corner to deflect a leading edge of the sheet material transported along the transportation path.

In many embodiments, the first elongated side includes an opening disposed to a side of the first elongated side to inhibit adhesive buildup.

In many embodiments, the fixed-knife cutting edge faces up and the movable-knife cutting edge faces down.

In many embodiments, the exit includes a downward sloped surface to support the cut-off portion of the sheet material during discharge.

In many embodiments, the second elongated side is located immediately adjacent the transportation path. For example, the second elongated surface can be offset by less than or equal to 2 mm.

In another aspect, a printer is provided with a cutter for cutting off a portion of a recording medium. The printer includes a transportation path from a printing position to a recording-medium exit, a transportation mechanism that conveys recording medium along the transportation path, a fixed knife having a cutting edge, a movable knife having a cutting edge and moving between a standby position and a cutting-completed position to cut off the portion in cooperation with the fixed knife, and an exit disposed along the transportation path and adjacent the knives to discharge the cut-off portion. The exit includes a narrow substantially-rectangular opening defined at least in part by a first elongated side offset from the transportation path beyond the movable-knife cutting edge in the cutting-completed position, and a second elongated side opposite the first elongated side and offset from the transportation path opposite to the first elongated side.

In many embodiments, the printer further includes a case and a cover that opens and closes to the case, with the movable knife disposed to the case and the fixed knife disposed to the cover.

In such embodiments, having the fixed knife disposed to, for example, an access cover that opens and closes a roll paper compartment in which roll paper is stored, recording paper can be easily pulled from the paper roll and passed between the fixed knife and the movable knife when the access cover is opened and roll paper is loaded.

In many embodiments, the fixed-knife cutting edge is disposed close to the transportation path. For example, the fixed-knife cutting edge can be disposed substantially on the transportation path.

In many embodiments, a roller is disposed to the second elongated side of the exit. In such embodiments, the sheet material conveyed toward the cutter will therefore not hit a surface on the second elongated side of the exit and cause a paper jam. With this configuration the sheet material is guided smoothly as the roller rotates.

In many embodiments, protrusions are formed on the outside surface of the roller.

The sheet material is thus guided in contact with the end points of the protrusions formed on the outside surface of the roller. Smudging or smearing of a printed portion of the sheet material due to rubbing can thus be avoided when the surface of the sheet material has been printed on. In addition, when handling label paper, for example, there is no rubbing of the label paper against the first elongated side of the exit, and transfer and adhesion of adhesive from the label paper to the roller or protrusions may be reduced or prevented.

In many embodiments, the movable knife pivots on a support shaft between the standby position and the cutting-completed position.

In many embodiments, the second elongated side of the exit includes a sloped corner to deflect a leading edge of the sheet material transported along the transportation path. In many embodiments, the first elongated side includes an opening disposed to a side of the first elongated side to inhibit adhesive buildup.

In many embodiments, the fixed-knife cutting edge faces up and the movable-knife cutting edge faces down.

In many embodiments, the exit includes a downward sloped surface to support the cut-off portion of the sheet material during discharge.

In many embodiments, the movable knife and the fixed knife overlap in the cutting-completed position.

In many embodiments, the second elongated side is located immediately adjacent the transportation path. For example, the second elongated surface can be offset by less than or equal to 2 mm.

In another aspect, a cutter is provided that cuts and discharges from a paper exit paper inserted between a fixed knife and a movable knife, wherein the movable knife is configured to move between a standby position at which a specific gap is formed between the movable knife and the fixed knife, and an cutting-completed position at which the movable knife and the fixed knife overlap, and the paper exit has opposing surfaces. One opposing surface is a stage surface that extends along the fixed knife on the outside from the cutting edge of the movable knife at the cutting-completed position, and the other opposing surface is at substantially the same height as the cutting edge of the fixed knife on the downstream side of the movable knife in the paper discharge direction.

In this aspect of the invention the size of the opening of the paper exit is determined by the stage surface and the opposing surface, and the gap between the stage surface and this opposing surface can be limited to the narrow size of the opening from a position outside of the cutting edge of the movable knife in the cutting completed position to substantially the same position as the cutting edge of the fixed knife. Insertion of foreign objects to the paper exit from outside may therefore be inhibited or prevented.

In addition, a problem with the related art is that when cutting paper, the cutting edge of the movable knife moves outside the edge of the paper exit, the movable knife pinches the upstream end of the cut-off portion, and paper jams may result. In addition, the cut-off portion may curl, the curled part of the cut-off portion may spring back when the movable knife returns to the standby position, and the cut-off portion may thus pop out from the paper exit.

In this aspect of the invention, however, the edge of the paper exit on the fixed knife side is determined by the stage surface, and this stage surface is outside the cutting edge of the movable knife in the cutting completed position, and extends horizontally for a specific width in the cutting direction (widthwise to the paper) along a surface of the fixed knife on the downstream side in the paper transportation direction. Therefore, even when the movable knife moves to the cutting-completed position, the upstream end part of the cut-off portion is always above the edge of the paper exit, and will not be pinched or curled. In addition, when cutting is completed, the cut-off portion is deposited on the horizontal stage surface, and is left resting stably. As a result, paper jams may be prevented. And because the cut-off portion will not pop out of the paper exit and become scattered when the movable knife returns the standby position, the operator can easily remove the cut-off portion from the paper exit.

In many embodiments, a corner of the opposing surface on the upstream side in the paper discharge direction is sloped in order to guide paper passing between the fixed knife and the movable knife in the standby position between the stage surface and the opposing surface.

The paper conveyed toward the cutter will therefore not hit the surface on the fixed knife side of the paper exit and cause a paper jam. In this configuration the paper is guided smoothly along the inclined corner on the upstream side.

In many embodiments, a rectangular recessed part is formed at a corner of the opposing surface on the upstream side, and a roller is disposed in the recessed part substantially parallel to the stage surface with the outside surface part of the roller exposed from the recessed part, in order to guide paper passing between the fixed knife and the movable knife in the standby position between the stage surface and the opposing surface.

In many embodiments, protrusions are formed on the outside surface of the roller. In such embodiments, the paper may be guided smoothly as the roller turns when a continuous web of paper is guided between the stage surface and the opposing surface. The paper may also be guided partially touching the protrusions on the outside surface of the roller. As a result, because sliding of the surface of the paper in contact with the opposing surfaces may be reduced or avoided, smudging the printed portion of the surface when the surface of the paper has been printed on may be avoided. In addition, when handling label paper, for example, there is no rubbing against the surface on the movable knife side, and, as a result, transfer and adhesion of adhesive from the label paper to the roller or protrusions may be reduced or prevented.

In many embodiments, the fixed knife is disposed with the cutting edge facing up. And the movable knife is disposed with the cutting edge facing down. And a sloped guide surface can be formed extending downward in the downstream direction of the paper discharge direction from the downstream side of the stage surface in the paper discharge direction to support the cut-off portion during discharge.

Effect of at Least of one Embodiment of the Invention

With the cutter and printer having a cutter according to at least of one embodiment of the invention, the paper exit is defined by mutually opposing surfaces, and the size of the opening between these opposing surfaces can be limited to a short distance of an opening from outside the range of movable knife movement to substantially the same position as the cutting edge of the fixed knife. Insertion of foreign objects from outside the paper exit may therefore be reduced or prevented.

In addition, a problem with the related art is that when cutting paper the cutting edge of the movable knife moves beyond the edge of the paper exit thereby pushing the upstream end part of the cut-off portion beyond the edge of the paper exit, which may cause a paper jam. And pushing the upstream end part beyond the edge of the paper exit may cause the upstream end part of the cut-off portion to curl, resulting in the curled part of the cut-off portion springing back when the movable knife returns to the standby position, and the cut-off portion falling out from the paper exit.

With the disclosed paper cutters, however, the surface of the paper exit on the fixed knife side is formed outside the range of movable knife movement when the movable knife cuts. Therefore, because the movable knife does not push the upstream end part of the cut-off portion beyond the edge of the exit when the knife moves, the upstream end part of the cut-off portion is always inside the edge of the paper exit, and paper jams and curling may be inhibited or prevented. The ease of use of the device is therefore good because the occurrence of problems such as paper jams are reduced or eliminated, and the cut-off portion may be prevented from spring out of the paper exit and scattering when the movable knife returns to the standby position.

Other objects and attainments together with a fuller understanding of the invention will become apparent and appreciated by referring to the following description and claims taken in conjunction with the accompanying drawings.

DETAILED DESCRIPTION

In the following description, various embodiments of the present invention will be described. For purposes of explanation, specific configurations and details are set forth in order to provide a thorough understanding of the embodiments. However, the present invention can be practiced without the specific details. Furthermore, well-known features may be omitted or simplified in order not to obscure the embodiment being described.

General Configuration

Figure 1A:
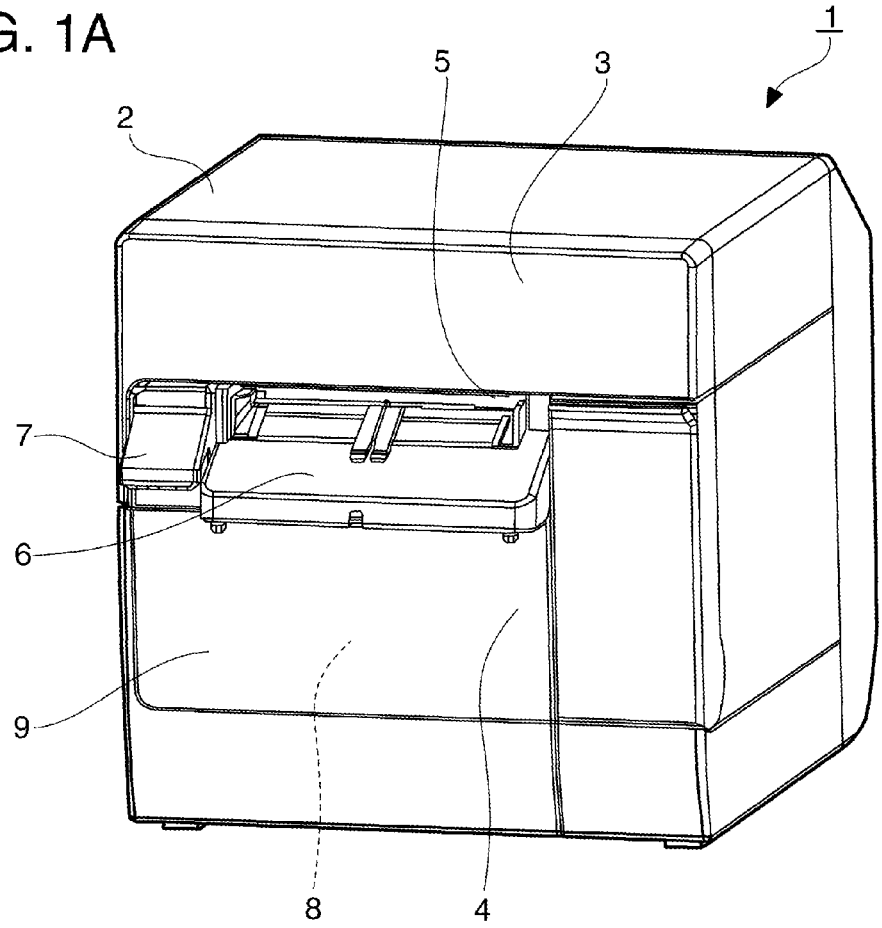
FIG. 1A is an oblique view of a printer with an automatic cutter, in accordance with many embodiments.
Figure 1B:
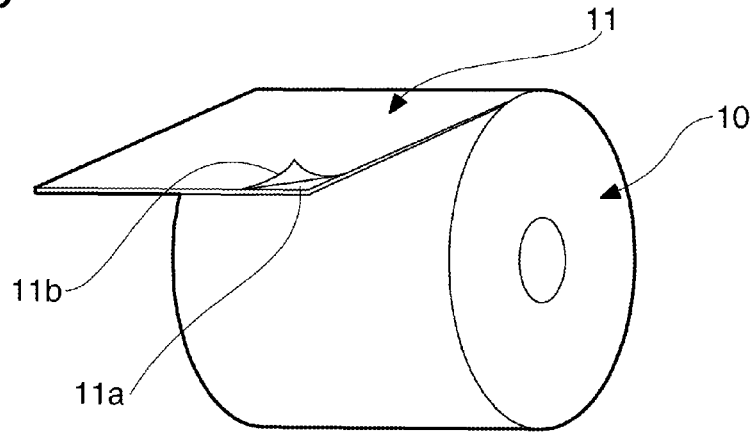
FIG. 1B is an oblique view of roll paper.
Figure 2:
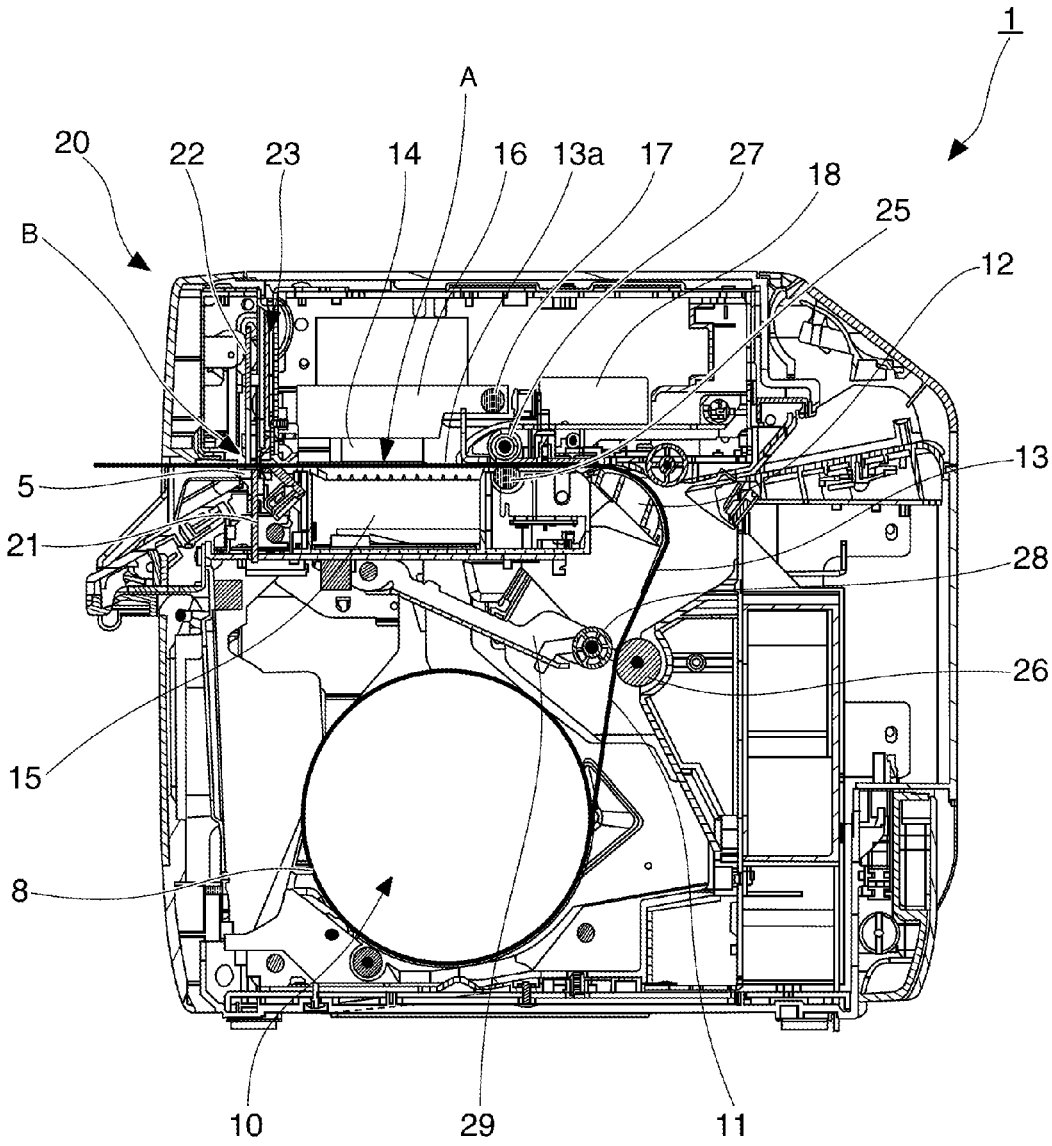
FIG. 2 is a section view showing internal components of the printer of FIG. 1A.

Referring now to the drawings, in which like reference numerals represent like parts throughout the several views, FIG. 1A is an oblique view of a printer with an automatic cutter, in accordance with many embodiments. FIG. 1B is an oblique view of roll paper that is used in the printer of FIG. 1A. FIG. 2 is a section view showing the internal configuration of the printer of FIG. 1A.

As shown in FIG. 1A, the printer with automatic cutter 1 has a printer housing 2 having a generally rectangular box-like shape. The front of the printer housing 2 is covered by a top case 3 and a bottom case 4, and has a rectangular paper exit 5 of a specific width formed therebetween. A paper exit guide 6 protrudes to the front below the paper exit 5, and a opening/closing lever 7 is disposed beside the paper exit guide 6. An opening to a roll paper compartment 8 formed inside the printer housing 2 is formed in the bottom case 4 below the paper exit guide 6 and the opening/closing lever 7. And this opening is closed by an access cover 9. When the opening/closing lever 7 is operated and the access cover 9 (cover) opened, the roll paper 10 can be loaded into the roll paper compartment 8.

Various types of paper can be used as the roll paper 10, including roll paper having a continuous web of recording paper of a specific width wound into a roll, rolls of label paper having labels of a predetermined shape (e.g., die-cut labels (that is, individually cut labels)) affixed at a predetermined interval on the surface of a continuous web liner of a predetermined width, and rolls of label paper having a continuous web of label stock of a predetermined width affixed to the surface of a continuous web liner of a predetermined width (continuous label paper (label paper on which the label stock is not cut into individual labels, may also include butt-cut labels)).

As shown in FIG. 1B, the roll paper 10 can include label paper 11 having a continuous label (or butt-cut labels) 11*b* affixed to the web liner 11*a* wound into a roll by way of example.

As shown in FIG. 2, the roll paper compartment 8 is formed between the side walls of the printer housing 2 inside the printer with automatic cutter 1. The roll paper 10 is stored in the roll paper compartment 8 with the axis of the roll paper 10 disposed horizontally widthwise to the printer.

The label paper 11 web delivered from the roll paper 10 loaded in the roll paper compartment 8 is pulled diagonally upward, then curves around a curved tension guide 12, and is then conveyed through a paper transportation path 13 that extends horizontally to the paper exit 5. The tension guide 12 is urged upward by the force of a spring to maintain a specific tension on the label paper 11 passing around the tension guide 12.

The horizontal portion of the paper transportation path 13 is directly above the roll paper compartment 8. An inkjet print head 14 and vacuum platen 15 are disposed in mutual opposition with a specific gap therebetween in this horizontal transportation path portion 13*a*, and the printing position A of the inkjet print head 14 is determined by the vacuum platen 15. The inkjet print head 14 is carried on a carriage 16, and the carriage 16 is moved bidirectionally widthwise to the printer along a carriage guide shaft 17 by means of a carriage motor 18.

A cutting position B is disposed on the downstream side in the transportation direction of the paper transportation path 13 from the printing position A. The automatic cutter 20 is disposed to the cutting position B, and the label paper 11 printed at the printing position A is cut widthwise to the printer (across the paper width) at this cutting position B.

The automatic cutter 20 includes a fixed knife 21 disposed with the cutting edge facing up, a movable knife 22 disposed with the cutting edge facing down, a movable knife drive mechanism 23, and the paper exit 5. The paper exit 5 of the automatic cutter 20 is the paper exit 5 of the printer with automatic cutter 1. The fixed knife 21 and the movable knife 22 are disposed so that the cutting direction is aligned with the printer width. The fixed knife 21 is disposed on the upstream side in the paper transportation direction (paper discharge direction) of the paper transportation path 13, the movable knife 22 is disposed on the downstream side, and the paper exit 5 is on the downstream side of the movable knife 22.

The transportation mechanism for conveying the label paper 11 along the paper transportation path 13 includes a paper feed roller 25, a delivery roller 26, and a paper feed motor and delivery motor for rotationally driving these rollers. The paper feed roller 25 is located on the paper transportation path 13 upstream from the printing position A, and is rotationally driven by the paper feed motor. A first pressure roller 27 is pressed against and rotates in conjunction with the paper feed roller 25.

The delivery roller 26 is for supplying label paper 11 from the roll paper compartment 8, and is located upstream on the paper transportation path 13 from the tension guide 12. The delivery roller 26 is rotationally driven by a delivery motor, and a second pressure roller 28 is pressed against and rotates in conjunction with the delivery roller 26. The second pressure roller 28 is attached to a distal end part of a pressure lever 29 that extends toward the back from a position below the vacuum platen 15. This pressure lever 29 is pushed down by the force of a spring, and is urged to the delivery roller 26.

The label paper 11 pulled from the roll paper 10 in the roll paper compartment 8 is conveyed by the transportation mechanism through the paper transportation path 13. The inkjet print head 14 prints on the label side of the paper at the printing position A. The automatic cutter 20 cuts the label paper 11 at the cutting position B so that the cut-off portion 11*c* contains the printed area after printing is completed. A label of a desired length is thus issued from the paper exit.

Automatic Cutter

Figure 3:
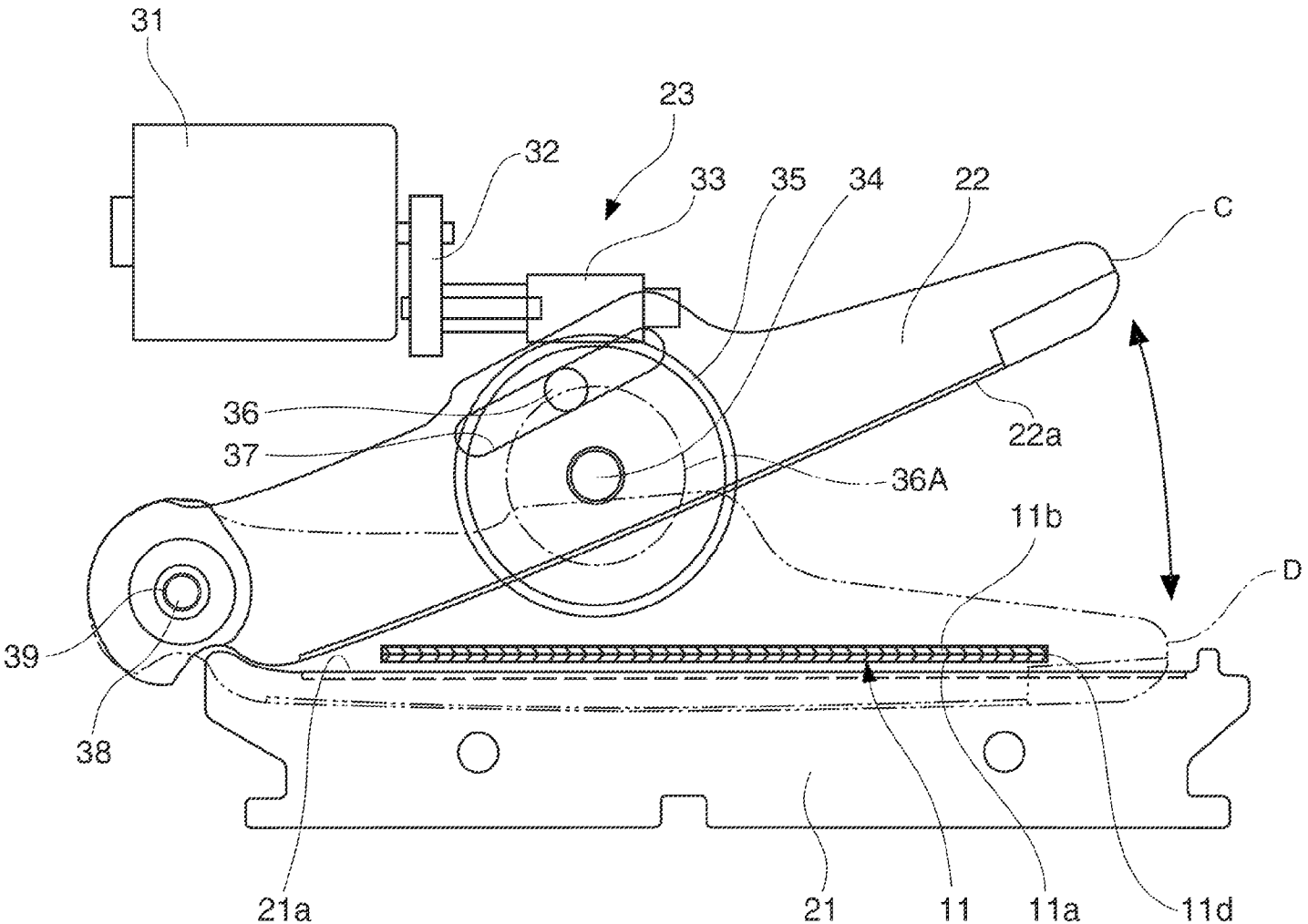
FIG. 3 is a schematic diagram of an automatic cutter in accordance with many embodiments.

FIG. 3 is a schematic view of the fixed knife 21, the movable knife 22, and the movable knife drive mechanism 23 of the automatic cutter 20.

The automatic cutter 20 in this embodiment of the invention is a scissor cutter. Torque from a cutter motor 31 causes the movable knife 22 to pivot up and down at one end thereof widthwise to the printer between a standby position C (denoted by the solid line in FIG. 2) where a specific gap is formed between the cutting edge 22*a* of the movable knife 22 and the cutting edge 21*a* of the fixed knife 21, and a cutting-completed position D (denoted by the imaginary line in FIG. 3) where the cutting edge 22*a* of the movable knife 22 and the cutting edge 21*a* of the fixed knife 21 overlap throughout the entire range thereof widthwise to the printer (the cutting direction).

The movable knife drive mechanism 23 includes a worm gear 33 that is rotationally driven by the cutter motor 31 through a power transfer mechanism 32. The worm gear 33 meshes with a worm wheel 35 that is affixed to rotate freely on a support shaft 34. The rotational motion of the worm wheel 35 is converted by a crank mechanism to the bidirectional vertical motion of the movable knife 22.

The crank mechanism includes a crank pin 36 attached perpendicularly to a round end face of the worm wheel 35 at a position offset from the axis of rotation, and a straight slide channel 37 of a specific length formed in the movable knife 22. The crank pin 36 is inserted so that it can slide in the slide channel 37, and rotates along a circular path of rotation 36A denoted by the dot-dash line in FIG. 3 in conjunction with rotation of the worm wheel 35.

The length of the slide channel 37 is set so that it can move tracking the movement of the crank pin 36 vertically and widthwise to the printer, and the movable knife 22 can pivot vertically on the support shaft 38 on which one end thereof is supported.

A coil spring 39 that pushes the movable knife 22 to the fixed knife 21 is disposed to the support shaft 38. And the contact force between the cutting edge 22*a* of the movable knife 22 and cutting edge 21*a* of the fixed knife 21 required to cut the label paper 11 can be provided by means of the urging force of this coil spring 39 alone or can be supplemented by the urging force of the crank mechanism.

When the worm wheel 35 turns one revolution, the movable knife 22 travels once back and forth between the standby position C and the cutting-completed position D (one stroke), and can cut the label paper 11 disposed between the movable knife 22 and the fixed knife 21 across the width of the paper.

In many embodiments, the fixed knife 21 is attached to the access cover 9 of the bottom case 4, and moves in front of the printer housing 2 together with the access cover 9 when the access cover 9 opens. The movable knife 22 is disposed on the top case 3 side of the paper transportation path. Therefore, when the access cover 9 is opened and the roll paper 10 is loaded, the label paper 11 can be easily pulled off from the roll paper 10 and placed between the fixed knife 21 and the movable knife 22.

Figure 4A:
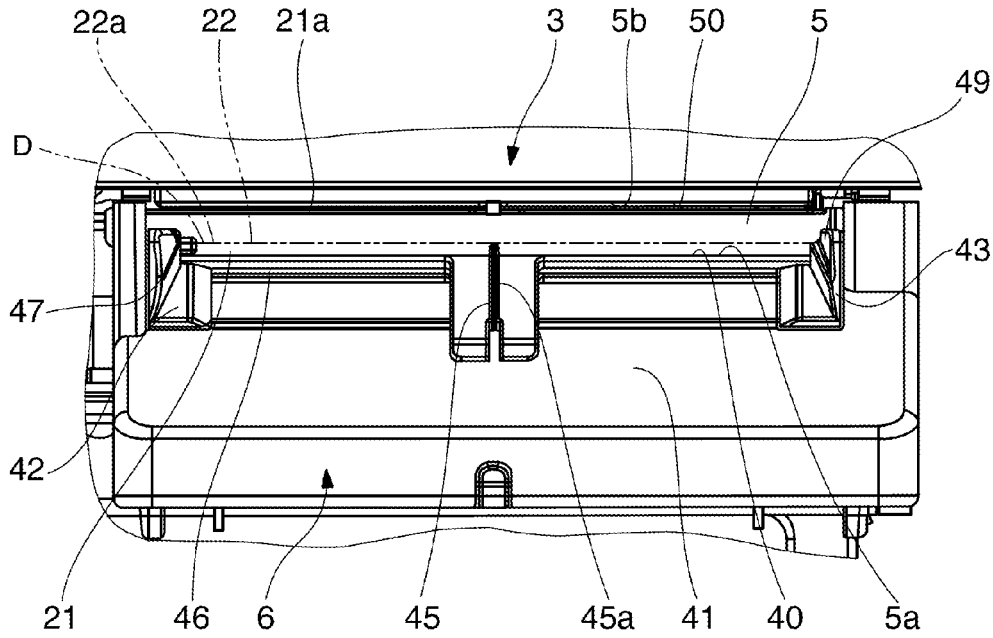
FIG. 4A is a front view showing a paper exit of the printer of FIG. 1A.
Figure 4B:
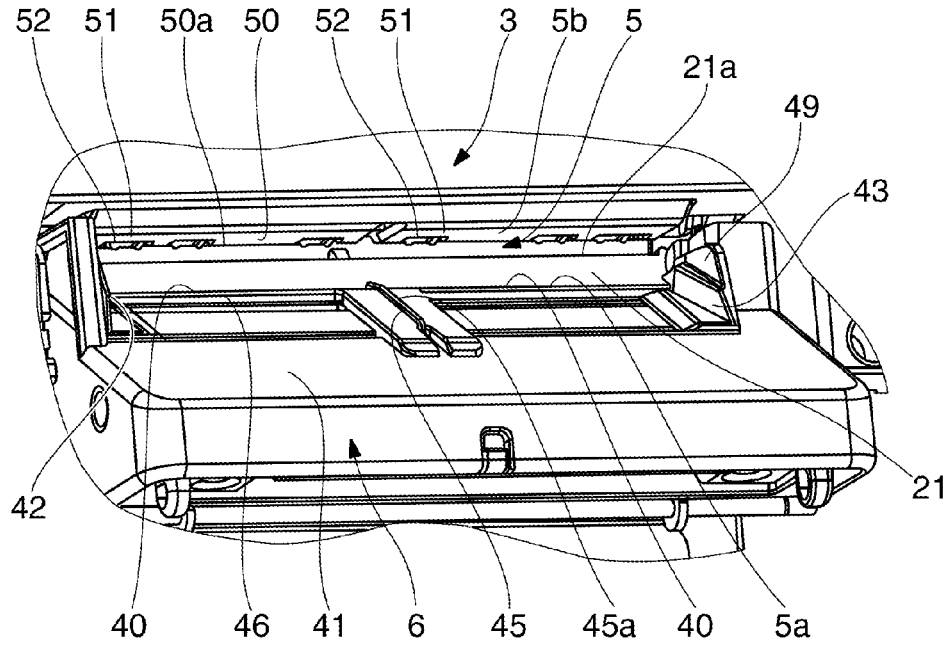
FIG. 4B is an oblique view showing the paper exit of FIG. 4A.
Figure 5A:
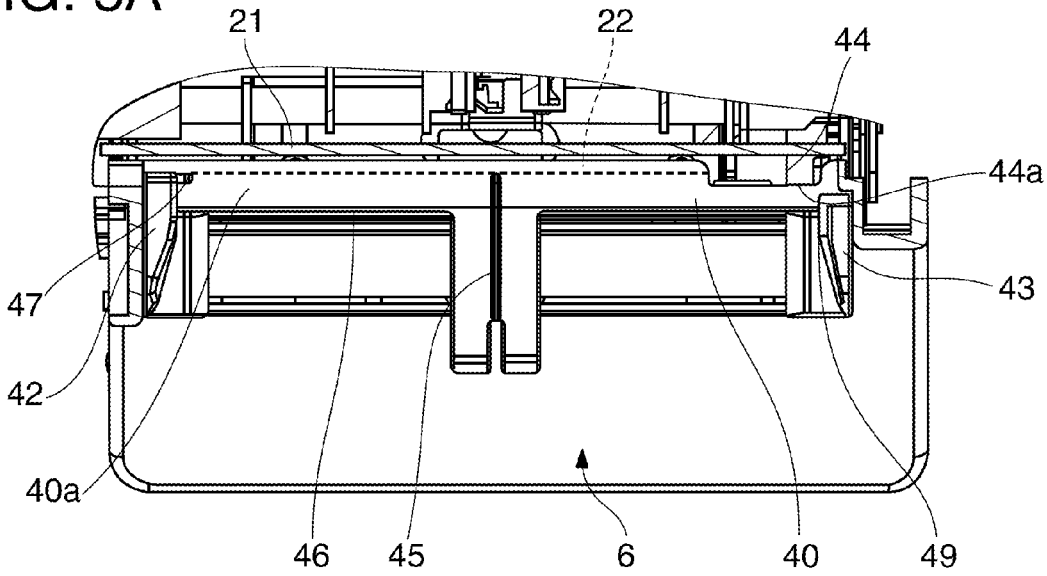
FIG. 5A is a plan view showing a paper exit guide of the paper exit of FIG. 4A.
Figure 5B:
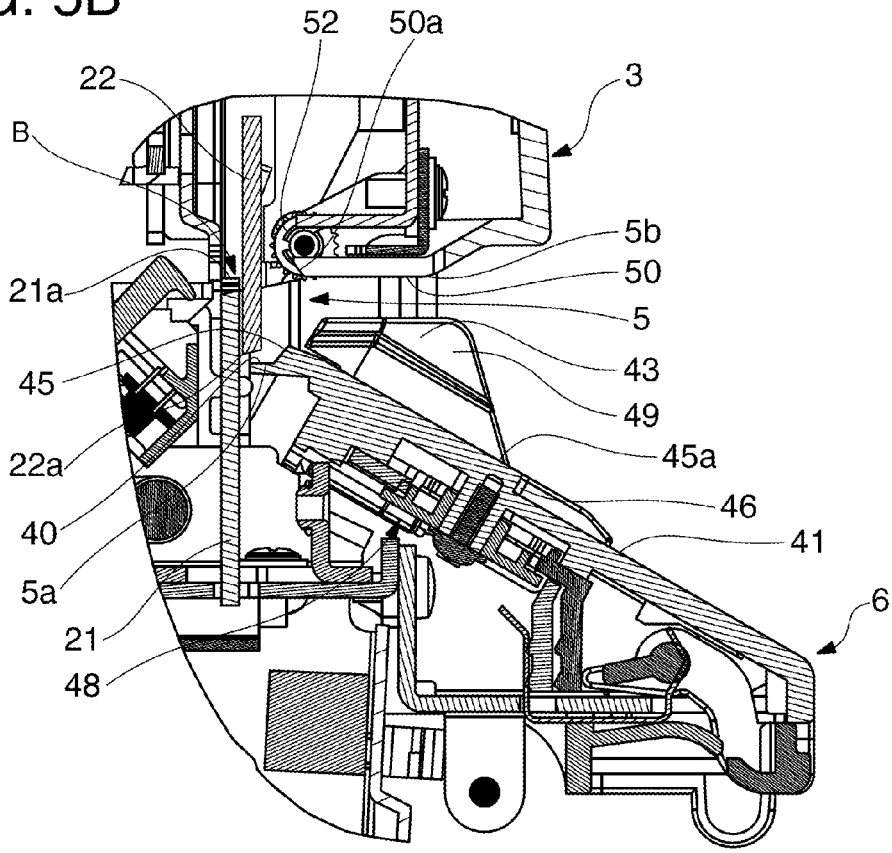
FIG. 5B is a vertical section view showing cutting knives of the automatic cutter and paper exit related components of the printer of FIG. 1.

The paper exit 5 is described next with reference to FIG. 4A through FIG. 5B. FIG. 4A is a front view showing the paper exit 5, and FIG. 4B is an oblique view showing the paper exit 5 as seen from diagonally below. FIG. 5A is a plan view showing the paper exit guide 6 with the top case 3 and movable knife 22 removed, and FIG. 5B is a vertical section view of the paper exit 5 through the paper transportation direction of the paper transportation path 13 when the fixed knife 21 is in the cutting-completed position D.

The paper exit 5 is a narrow, rectangular opening that is wide widthwise to the printer. The bottom edge 5*a* of the paper exit 5 is formed by the paper exit guide 6, and the top edge 5*b* of the paper exit 5 is formed by the top case 3.

The paper exit guide 6 has a stage surface 40 (the surface on the fixed knife side) of a specific width extending horizontally widthwise to the printer along the edge of the fixed knife 21 at a position slightly lower than the cutting edge 22*a* of the movable knife 22 in the cutting-completed position D, and a sloped guide surface 41 that extends downward toward the downstream side from downstream end edge of the stage surface 40. The paper exit guide 6 also has a first side wall 42 that defines one side of the paper exit guide 6 widthwise to the printer where the label paper 11 passes over the stage surface 40 and the sloped guide surface 41, and a second side wall 43 that defines the other side. The stage surface 40 defines the bottom edge 5*a* of the paper exit 5.

As shown in FIG. 5A, a rectangular notched opening 44 (recessed part) that is narrow and long widthwise to the printer is formed at the upstream end edge of the stage surface 40 at one end of the stage surface 40. The notched opening 44 is formed to include a stage surface part 40*a* downstream from the movable knife 22 denoted by the dotted line. More specifically, the downstream edge 44*a* of the notched opening 44 is located downstream from the movable knife 22.

A long, narrow protrusion 45 extending in the paper transportation direction from the stage surface part 40*a* to the sloped guide surface 41 is formed in the middle of the stage surface 40 widthwise to the printer. The top surface 45*a* of the protrusion 45 slopes downward in the downstream direction, and enables the operator to easily grip the cut-off portion 11*c*.

The first side wall 42 is configured so that it can move widthwise to the printer sliding on the stage surface part 40*a*, the sloped guide surface 41, and the stepped surface 46 between the stage surface part 40*a* and the sloped guide surface 41. A protrusion 47 that projects to the second side wall 43 side is formed at an upstream end part of the first side wall 42. The top end of this protrusion 47 is at a height that is lower than the cutting edge 21*a* of the fixed knife 21.

The second side wall 43 is configured so that it can slide widthwise to the printer sliding on the surface part of the stage surface part 40*a* downstream from the downstream edge 44*a* of the notched opening 44, the sloped guide surface 41, and the stepped surface 46.

As shown in FIG. 5B, a linkage mechanism 48 is disposed on the back side of the sloped guide surface 41. This linkage mechanism 48 causes the second side wall 43 to move the same distance in the opposite direction as the first side wall 42 when the first side wall 42 is moved widthwise to the printer, and the second side wall 43 thus moves in conjunction with movement of the first side wall 42. Different widths of paper can thus be accommodated. The top part on the inside face of the second side wall 43 facing the first side wall 42 is cut away, rendering a notched step 49.

A paper exit ceiling 50 (opposing surface) extending horizontally opposite the stage surface 40 at substantially the same height as the cutting edge 21*a* of the fixed knife 21 is formed at the bottom edge part of the top case 3 on the downstream side of the movable knife 22. This paper exit ceiling 50 defines the top edge 5*b* of the paper exit 5. The upstream edge 50*a* of the paper exit ceiling 50 slopes upward. A plurality of rectangular notches 51 is formed in the upstream edge 50*a* of the paper exit ceiling 50, and the outside surface part of a knobby roller 52 is exposed from each of the notches 51. These rollers 52 are disposed with the axis of rotation extending widthwise to the printer (across the paper width) above the stage surface 40. The outside surfaces on the bottom side of the knobby rollers 52 are opposite the stage surface 40, and the outside surfaces of the knobby rollers 52 on the upstream side are adjacent the movable knife 22.

Cutting and Discharging the Label Paper

Figure 6A:
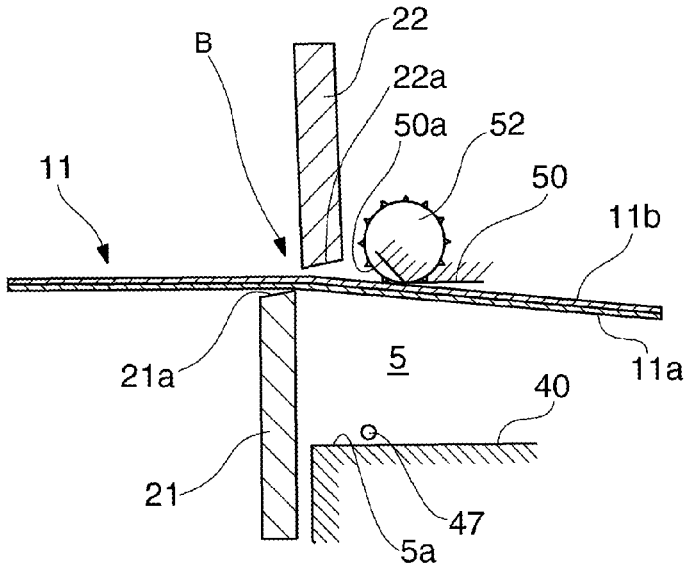
FIG. 6A and FIG. 6B illustrate cutting paper with an automatic cutter, in accordance with many embodiments.
Figure 6B:
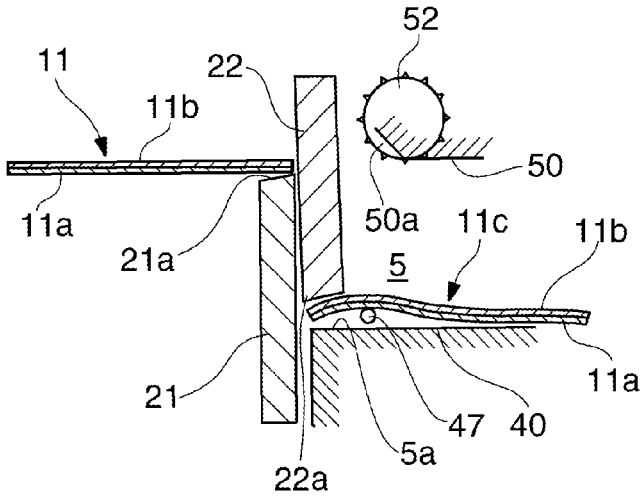
Figure 6C:
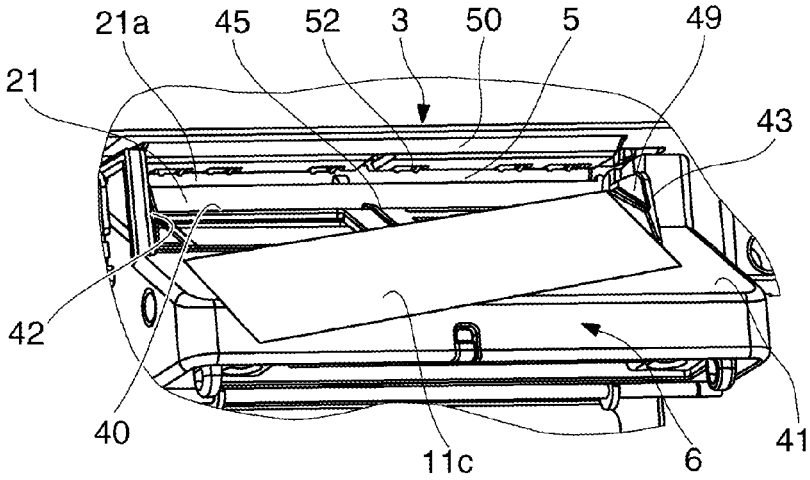
FIG. 6C illustrates the discharge of a cut-off portion of paper, in accordance with many embodiments.

Cutting and discharging the label paper 11 from the paper exit 5 is described next with reference to FIG. 6A and FIG. 6B. FIG. 6A schematically shows the label paper 11 passing the cutting position B. FIG. 6B shows immediately after the label paper 11 is cut. And FIG. 6C shows the cut-off portion discharged from the paper exit.

The label paper 11 printed at the printing position A is conveyed by the transportation mechanism to the position where the printed portion on the label side (the end-of-printing position) is downstream from the cutting position B. When the label paper 11 passes the cutting position B, the label paper 11 is guided smoothly to the downstream side of the paper exit 5 while the knobby rollers 52 rotate with the label surface in contact with the tips of the knobs on the outside surfaces of the knobby rollers 52 as shown in FIG. 6A.

As a result, the printed portion will not rub against the paper exit ceiling 50 and be damaged when the ink in the printed portion formed on the label surface of the continuous label 11*b* is not completely dry. Furthermore, because the outside surface and the knobs of the knobby rollers 52 partially contact the label surface while the knobby rollers 52 rotate, adhesion of adhesive resulting from the continuous label 11*b* rubbing against the paper exit ceiling 50 and adhesive from the label surface sticking thereto is also suppressed.

When paper transportation stops, the movable knife 22 moves from the standby position C to the cutting-completed position D. As a result, the point of intersection with the cutting edge 21*a* of the fixed knife 21 moves from one end to the other widthwise to the printer, and the part of the label paper 11 positioned therebetween is cut.

Figure 7:
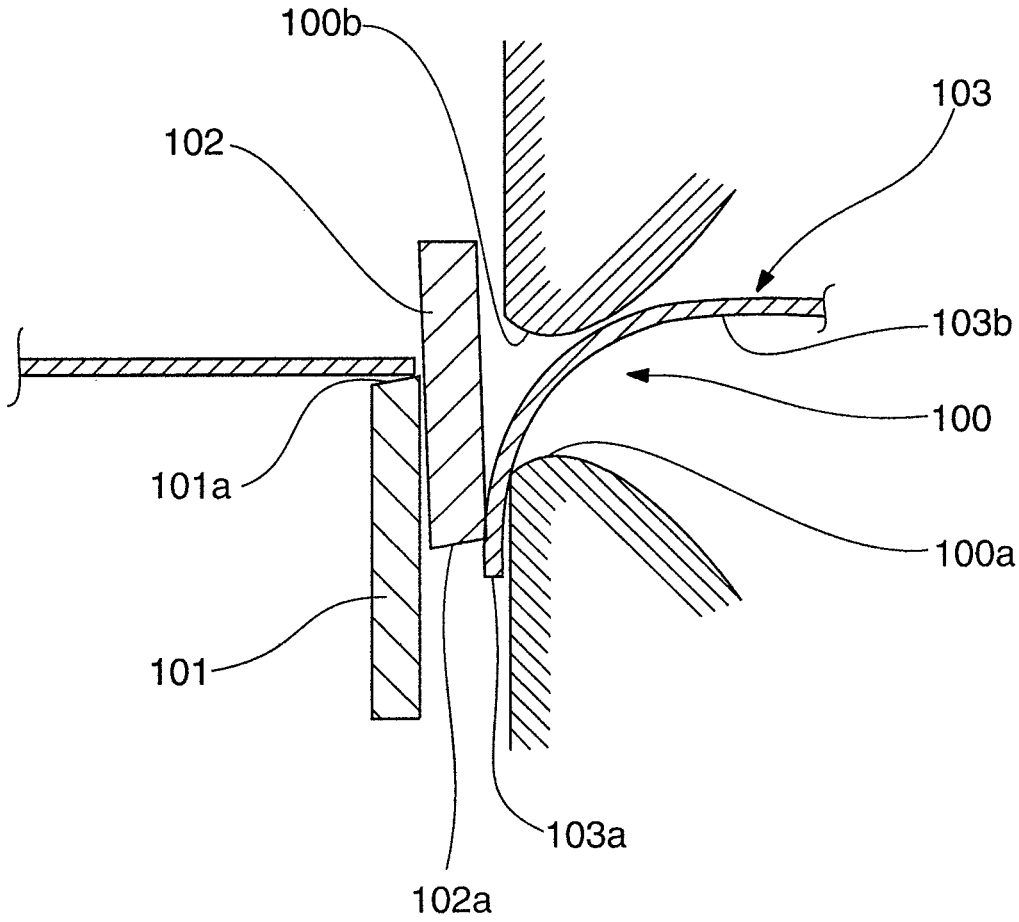
PRIOR ART FIG. 7
FIG. 7 illustrates cutting by means of an automatic cutter according to the related art.

To prevent the paper conveyed toward the automatic cutter from colliding with the top edge 100*b* (shown in FIG. 7) and causing a paper jam, the position of the bottom edge 100*a* and the top edge 100*b* of the paper exit 100 and the position of the cutting edge 101*a* of the fixed knife 101 are positioned in the related art so that paper conveyed toward the automatic cutter is directed substantially to the center of the gap between this bottom edge 100*a* and top edge 100*b*. A certain stroke is also required for the movable knife 102 to cut the paper when the movable knife 102 moves toward the cutting-completed position. As a result, the movable knife 22 pushes the upstream end part of the cut-off portion 11*c* of the label paper 11 down as a result of the cutting edge 22*a* of the movable knife 22 moving below the bottom edge 5*a* of the paper exit 5 when cutting the paper, and the cut-off portion 11*c* is thus caused to curl. When the movable knife 22 then returns to the standby position C, the curled part of the cut-off portion 11*c* springs back. And the cut-off portion 11*c* may pop out and away from the paper exit 5.

However, because the stage surface 40 that defines the bottom edge 5*a* of the paper exit 5 extends horizontally slightly below the position of the cutting edge 22*a* of the movable knife 22 when at the cutting-completed position D, the upstream end part of the cut-off portion 11*c* is always above the bottom edge 5*a* of the paper exit 5 as shown in FIG. 6B even when the movable knife 22 moves to the cutting-completed position D and the upstream end part of the cut-off portion 11*c* drops down. When cutting is complete, the upstream end part of the cut-off portion 11*c* is therefore deposited substantially flat on the stage surface 40 without the cut-off portion 11*c* being pinched and jamming or the upstream end part thereof being made to curl.

When the cut-off portion 11*c* is deposited on the stage surface 40, the cut-off portion 11*c* covers the top of the protrusion 47 projecting from the first side wall 42 and the protrusion 45 projecting from the center widthwise to the printer. As a result, the cut-off portion 11*c* is deposited on the stage surface 40 and supported slightly above the surface by the protrusion 47 and the protrusion 45. As shown in FIG. 6C, the downstream end of the cut-off portion 11*c* slides from the stage surface 40 along the sloped guide surface 41. And the operator can easily grip the cut-off portion 11*c* with the fingers.

Because the contact pressure of this scissor type automatic cutter 20 between the cutting edge 21*a* of the fixed knife 21 and the cutting edge 22*a* of the movable knife 22 is applied on the support shaft 38 side that is the pivot axis of the cutting edge 22*a*, the pressure weakens with distance from the support shaft 38 to the other side of the printer. As a result, adhesive between the web liner 11*a* and the continuous label 11*b* may be squeezed out from the other edge 11*d* of the label paper 11 widthwise to the printer (see FIG. 3) when the paper is cut, and may stick to the edge of the fixed knife 21 or the cutting edge 22*a* of the movable knife 22, or drop and accumulate on the stage surface 40. When adhesive sticks to the stage surface 40, the adhesive can get between the cutting edge 22*a* of the movable knife 22 and the cutting edge 21*a* of the fixed knife 21, eventually producing a gap between the cutting edges that can cause cutting problems. However, because a notched opening 44 (see FIG. 5A) is formed in the stage surface 40 in this embodiment of the invention, the adhesive moves from the notched opening 44 down. Adhesive therefore does not accumulate on the stage surface 40, and cutting problems caused by adhesive buildup may be avoided.

Effect of at Least of One Embodiment of the Invention

As described above, the gap between the stage surface 40 that defines the bottom edge 5*a* of the paper exit 5 and the paper exit ceiling 50 that defines the top edge 5*b* can be set to the narrow distance from slightly below the cutting edge 22*a* of the movable knife 22 in the cutting-completed position D and the top edge of the cutting edge 21*a* of the fixed knife 21. In many embodiments, in the cutting-completed position D, the overlap between the fixed knife 21 and movable knife 22 is approximately 5 mm, and the gap between the stage surface 40 and the paper exit ceiling 50 is approximately 6 mm. In many embodiments, the length of the stage surface 40 in the paper discharge direction is approximately 8 mm. The movable knife 22 will therefore not reach the stage surface 40 in the cutting-completed position D. Because of this dimensional relationship, the distal end of foreign objects inserted to the paper exit 5 from the outside may be prevented from reaching the movable knife 22.

Furthermore, because the bottom edge 5*a* of the paper exit 5 is determined by the stage surface 40, which extends horizontally slightly below the cutting edge 22*a* of the movable knife 22 in the cutting-completed position D, the cut-off portion 11*c* may not be pinched or curled during cutting. The cut-off portion 11*c* may also be deposited stably on the horizontal stage surface 40. As a result, paper jams may be prevented. And because the cut-off portion 11*c* is left on the stage surface 40 and the cut-off portion 11*c* will not spring out from the paper exit 5 and fall onto the floor or table when the movable knife 22 returns to the standby position C, the cut-off portion 11*c* can be easily removed by the operator.

Yet further, because the upstream edge 50*a* of the paper exit ceiling 50 (see FIG. 6B) slopes in the downstream direction of the transportation direction, the label paper 11 passing over the cutting edge 21*a* of the fixed knife 21 is guided smoothly even if contact is made between the label paper 11 and the paper exit ceiling 50.

In addition, because the outside surfaces of the knobby rollers 52 are exposed on the upstream side and below from the upstream edge 50*a*, the label paper 11 passing over the cutting edge 21*a* of the fixed knife 21 is guided to the downstream side of the paper exit 5 with the label surface contacting the tips of the knobs on the outside surfaces of the knobby rollers 52. As a result, damage caused by the printing on the continuous label 11*b* contacting the paper exit ceiling 50 is thus prevented. Thus, damage will not be caused by the printed portion being rubbed even when the continuous label

11*b* is printed by an inkjet print head 14 and the ink in the printed portion is not completely dry.

Paper jams caused by contact at the paper exit are also prevented. Yet further, because there are few parts where rubbing occurs, adhesive transfer is also minimal.

Note, further, that the roll paper is not limited to continuous label 11*b* paper, and die-cut label paper may be used. Plain paper may also be used instead of label paper.

Yet further, because a sloped guide surface 41 that extends downward in the downstream direction is formed from the downstream edge of the stage surface 40, the cut-off portion 11*c* can be easily removed by the operator.

Other Embodiments

The automatic cutter of at least of one embodiment of the invention is described above using a scissor type cutting mechanism, but the invention is not so limited. More particularly, the foregoing configuration of a paper exit having a stage surface and a paper exit ceiling surface can also be used with guillotine type automatic cutter mechanisms in which the movable knife moves to and away from the fixed knife bidirectionally in a straight line.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims.

What is claimed is:

1. A printer having a cutter for cutting off a portion of a sheet material transported along a substantially horizontal transportation path during operation of the printer, the cutter comprising:

a fixed knife having a cutting edge facing in an upwards direction relative the horizontal transportation;

a movable knife having a cutting edge facing in a downwards direction relative the horizontal transportation path and moving between a standby position and a cutting-completed position to cut off the portion in cooperation with the fixed knife, wherein the movable knife pivots on a horizontal axis parallel to the horizontal transportation path; and an exit disposed along the horizontal transportation path and on a downstream side of the knives in a transportation direction of the sheet material and that discharges the cut-off portion, the exit comprising a first surface offset from the transportation path beyond the cutting edge of the movable knife in the cutting-completed position, and a second surface opposite the first surface at a height substantially the same as a height of the cutting edge of the fixed knife wherein the second surface is immediately adjacent the movable knife and the first surface extends horizontally directly below the cutting edge of the movable knife in the cutting-complete position so that the cut off portion of the paper is not pushed vertically beyond the first surface during cutting so as to prevent curl and inadvertent springing movement of the paper after cutting.

2. The printer of claim 1, further comprising:

a notch formed in an upstream edge of the second surface in the transportation direction; and a roller disposed in the notch of the second surface that faces the movable knife and that guides the sheet material transported along the transportation path.

3. The printer cutter of claim 2, wherein an outside surface of the roller comprises protrusions.

4. The printer of claim 1, wherein the movable knife pivots on a support shaft extending in the transportation direction, the support shaft disposed between the standby position and the cutting-completed position.

5. The printer of claim 1, wherein the second surface comprises a sloped corner to deflect a leading edge of the sheet material transported along the transportation path.

6. The printer of claim 1, wherein the exit comprises a downward sloped surface to support the cut-off portion during discharge.

7. A printer with a cutter for cutting off a portion of a recording medium, the printer comprising:

a transportation path extending from a printing position to a recording-medium exit during operation of the printer; and a transportation mechanism that conveys the recording medium along the transportation path in a substantially horizontal transportation direction;

the cutter comprising:

a fixed knife having a cutting edge facing in an upwards direction relative the horizontal transportation path; and a movable knife having a cutting edge facing in a downwards direction relative the horizontal transportation path and moving between a standby position and a cutting-completed position to cut off the portion in cooperation with the fixed knife, wherein the movable knife pivots on a horizontal axis parallel to the horizontal transportation path wherein the recording-medium exit is disposed along the horizontal transportation path and on a downstream side of the knives in the transportation direction and that discharges the cut-off portion, the recording-medium exit comprising a first surface offset from the transportation path beyond the cutting edge of the movable knife in the cutting-completed position, and a second surface opposite the first surface at a height substantially the same as a height of the cutting edge of the fixed knife wherein the second surface is immediately adjacent the movable knife and the first surface extends horizontally directly below the cutting edge of the movable knife in the cutting-complete position so that the cut off portion of the paper is not pushed vertically beyond the first surface during cutting so as to prevent curl and inadvertent springing movement of the paper after cutting.

8. The printer of claim 7, further comprising:

a case; and a cover that opens and closes to the case, wherein the movable knife is disposed to the case and the fixed knife is disposed to the cover.

9. The printer of claim 7, further comprising:

a notch formed in an upstream edge of the second surface in the transportation direction; and a roller disposed in the notch of the second surface that faces the movable knife and that guides the recording medium transported along the transportation path.

10. The printer of claim 9, wherein an outside surface of the roller comprises protrusions.

11. The printer of claim 7, wherein the movable knife pivots on a support shaft extending in the transportation direction, the support shaft disposed between the standby position and the cutting-completed position.

12. The printer of claim 7, wherein the second elongated side comprises a sloped corner to deflect a leading edge of the recording medium transported along the transportation path.

13. The printer of claim 7, wherein the recording-medium exit comprises a downward sloped surface to support the cut-off portion during discharge.

14. The printer of claim 7, wherein the movable knife and the fixed knife overlap in the cutting-completed position.

* * * * *